US006170257B1

(12) United States Patent
Harada et al.

(10) Patent No.: US 6,170,257 B1
(45) Date of Patent: Jan. 9, 2001

(54) VARIABLE THRUST NOZZLE SYSTEM

(75) Inventors: Ken Harada; Yoshihiko Nishida; Kiyoyuki Watanabe, all of Kakamigahara (JP)

(73) Assignee: Kawasaki Jukogyo Kabushiki Kaisha, Kobe (JP)

( * ) Notice: Under 35 U.S.C. 154(b), the term of this patent shall be extended for 0 days.

(21) Appl. No.: 09/140,464

(22) Filed: Aug. 26, 1998

(30) Foreign Application Priority Data

Aug. 29, 1997 (JP) ..... 9-249788

(51) Int. Cl.[7] ..... F02K 1/18
(52) U.S. Cl. ..... 60/242
(58) Field of Search ..... 60/242, 229

(56) References Cited

U.S. PATENT DOCUMENTS 2,613,497 10/1952 MacDonald .
2,974,594 3/1961 Boehm .
3,478,965 11/1969 Llewellyn .
3,647,161 3/1972 Draim .

FOREIGN PATENT DOCUMENTS 0 489 712 A2 6/1992 (EP) .
1 559 055 3/1969 (FR) .

*Primary Examiner*—Timothy S. Thorpe
*Assistant Examiner*—Ehud Gartenberg
(74) *Attorney, Agent, or Firm*—Oliff & Berridge, PLC

(57) ABSTRACT

A variable thrust nozzle system comprises a housing, a pair of nozzle skirts. attached to the outer surface of the housing so as to open in opposite directions, respectively, a pair of nozzle plugs disposed in the pair of nozzle skirts so as to define a nozzle throat between the outer surface of each nozzle plug and the inner surface of the corresponding nozzle skirt, a shaft supported for sliding in the housing and having opposite ends connected to the nozzle plugs, respectively, and an actuator linked to the shaft to drive the shaft for sliding motions to vary the sectional areas of the nozzle throats.

9 Claims, 8 Drawing Sheets

VARIABLE THRUST NOZZLE SYSTEM

BACKGROUND OF THE INVENTION

1. Field of the Invention

The present invention relates to a variable thrust nozzle system capable of continuously and differentially varying its thrust to be exerted on a flying object.

2. Description of the Related Art

A known attitude and diversion controller for controlling the attitude and diversion of a flying object flying at high altitudes makes outside nozzles attached to an airframe of the flying object jet a high-temperature high-pressure gas to control the attitude and diversion of the flying object about five axes without using aerodynamic force.

FIGS. 12 and 13 show a basic thrust generating mechanism for this known attitude and diversion controller. The thrust generating mechanism has four nozzles 30 each having a throat 31, and four nozzle plugs 32 combined respectively with the nozzles 30. Each nozzle plug 32 opens and closes the corresponding throat 31 to control the flow of a gas through the corresponding nozzle 30. Therefore, the thrust generating mechanism needs one actuator for each nozzle 30. An excessively large force is necessary for closing the nozzles 30. The attitude and diversion controller operates in a PWM (pulse width modulation) control mode for a fast-response control operation. Accordingly, the attitude and diversion controller is large and has a complicated configuration. This known attitude and diversion controller has difficulty in continuously or differentialy varying the sectional area of the throat 31 of each nozzle by the operation of the nozzle plug 32, so that the attitude and diversion controller has difficulty in continuously or differentially varying the thrust of the gas jetted through each nozzle 30.

SUMMARY OF THE INVENTION

Accordingly, it is an object of the present invention to provide a variable thrust nozzle system having an actuator capable of controlling two nozzles for alternate opening and closing, capable of operating smoothly, having a simple configuration and capable of continuously and differentially varying the respective sectional areas of the throats of the two nozzles to vary the respective thrusts of the two nozzles continuously and differentially.

With the foregoing object in view, according to one aspect of the present invention, a variable thrust nozzle system comprises a housing; a pair of nozzle skirts attached to an outer surface of the housing so as to open in opposite directions, respectively; a pair of nozzle plugs disposed in the pair of nozzle skirts so as to define a nozzle throat between an outer surface of each of the nozzle plugs and an inner surface of each of the corresponding nozzle skirts; a shaft supported for sliding in the housing and having opposite ends connected to the nozzle plugs, respectively; and an actuator linked to the shaft to drive the shaft for sliding motions to vary the sectional areas of the nozzle throats.

The variable thrust nozzle system of the present invention opens one of the two nozzles and closes the other nozzle by the single actuator. Thus, the variable thrust nozzle system operates smoothly, has a simple configuration and a lightweight construction, and can easily be designed and mounted on a flying object. Thrust exerted on the flying object can continuously and differentially be varied by continuously and differentially varying the respective sectional areas of the pair of nozzles by the single actuator.

Accordingly, when six variable thrust nozzle systems in accordance with the present invention at the most are disposed symmetrically on the six sides of a platform, the platform can be controlled for operations in six degrees of freedom of motion, i.e., motions with respect to six axes including turning motions about three axes and translating motions along the three axes.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
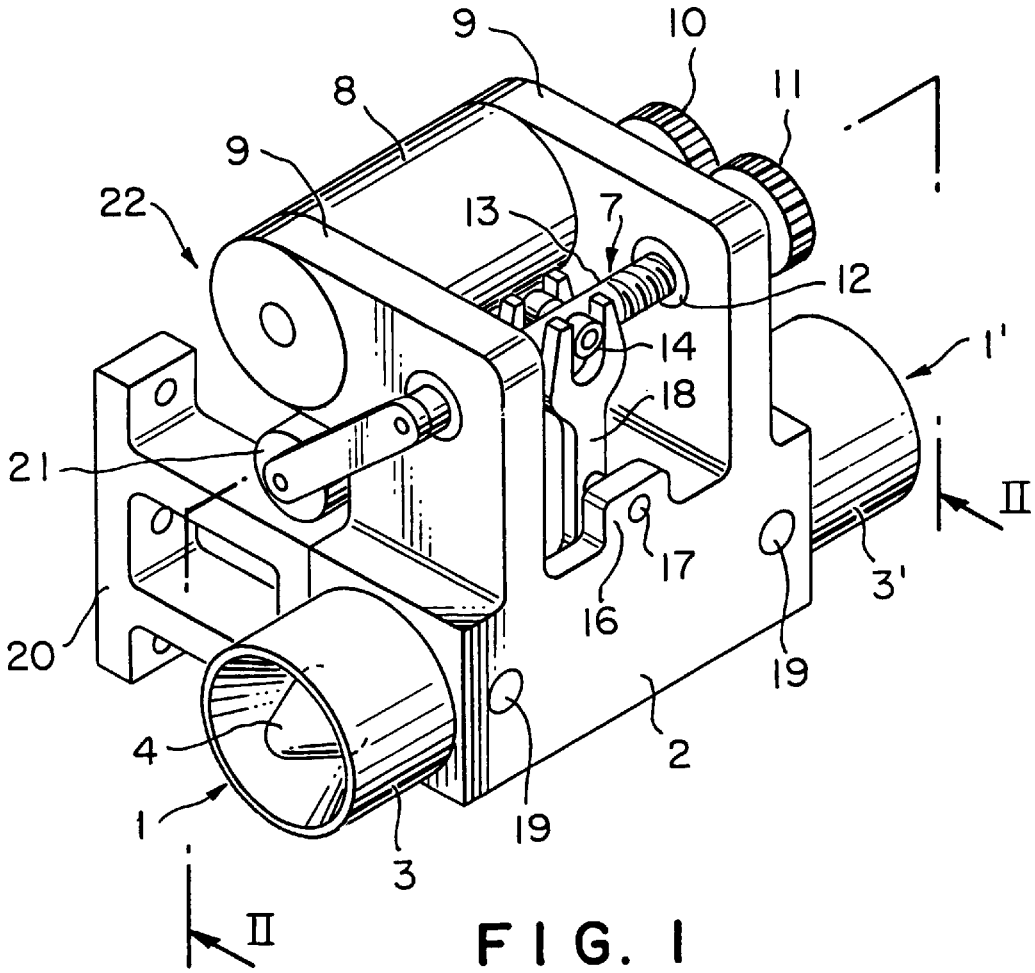
FIG. 1 is a perspective view of a variable thrust nozzle system in a preferred embodiment according to the present invention.
Figure 2:
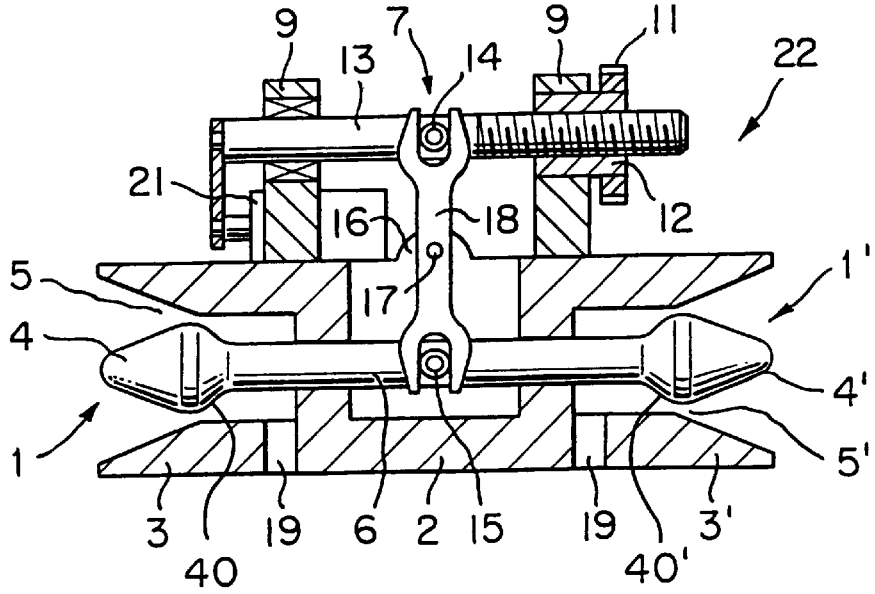
FIG. 2 is a longitudinal sectional view taken on line II—II in FIG. 1.
Figure 3:
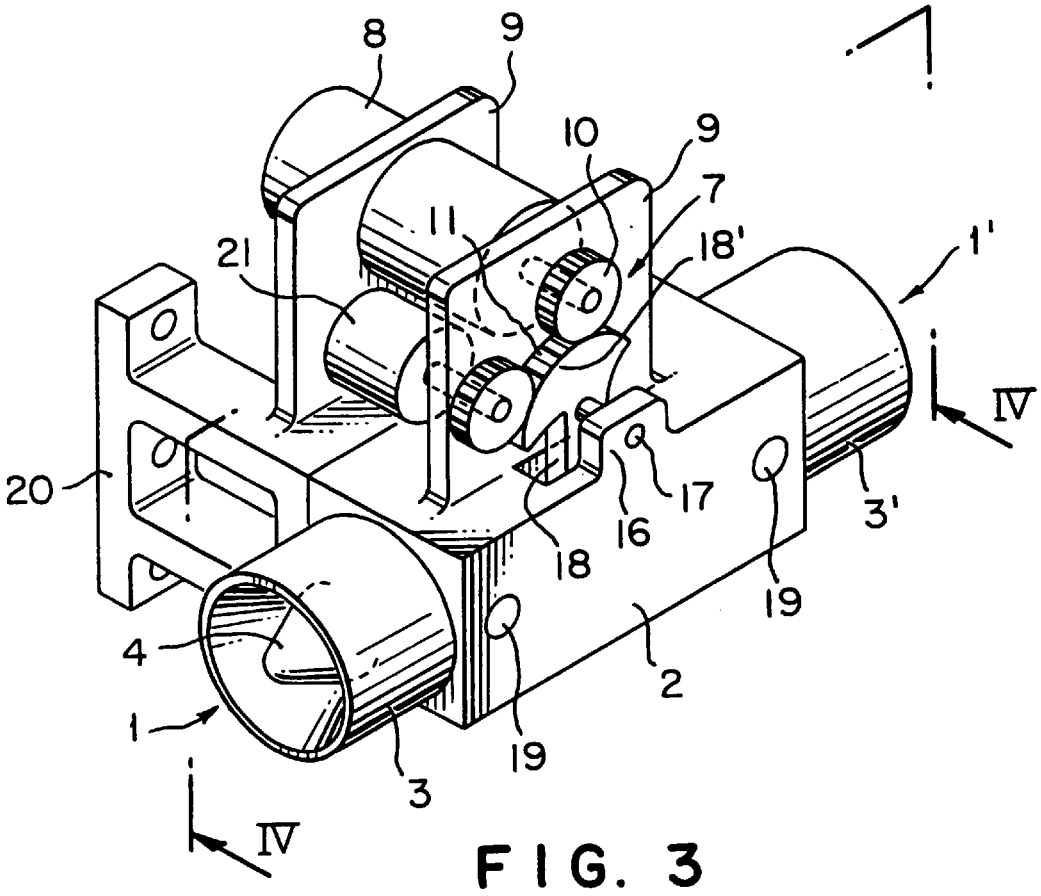
FIG. 3 is a perspective view of a variable thrust nozzle system in a modification of the variable thrust nozzle system of FIG. 1.
Figure 4:
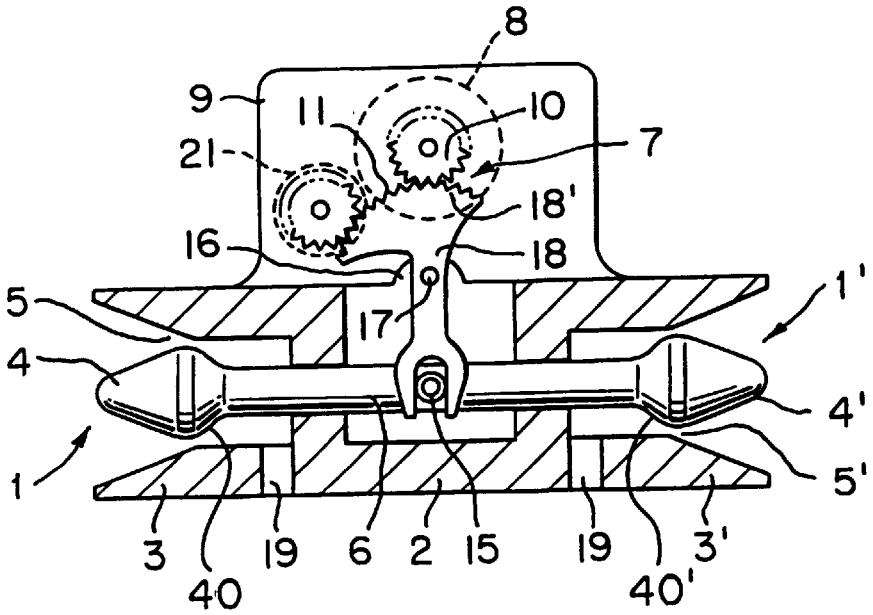
FIG. 4 is a longitudinal sectional view taken on line IV—IV in FIG. 3.

Referring to FIGS. 1 and 2 showing a variable thrust nozzle system 22 in one embodiment according to the present invention, a pair of nozzles 1 and 1' are attached to the opposite end surfaces, respectively, of a housing 2. As best shown in FIG. 2, the nozzle 1 (1') has a nozzle skirt 3 (3') formed integrally with the housing 2 on the end surface of the housing 2, and a nozzle plug 4 (4') supported coaxially with the nozzle skirt 3 (3'). A nozzle throat 5 (5') is defined by the inner circumference of the nozzle skirt 3 (3') and the outer surface of the nozzle plug 4 (4'). The nozzle plugs 4 and 4' of the pair of nozzles 1 and 1' are connected to the opposite ends of a shaft 6 supported for axial movement in the housing 2. Each nozzle plug 4 and 4' includes an inwardly converging portion 40 an 40', respectively, that receives gas pressure in the housing. A servomotor 8, i.e., an actuator, is linked to the shaft 6 by an interlocking mechanism 7. The servomotor 8 is supported on brackets 9 formed outside the housing 2. The interlocking mechanism 7 for linking the servomotor 8 to the shaft 6 comprises a drive gear 10 fixedly mounted on the output shaft of the servomotor 8, a screw shaft 13 linked to a threaded nut 12 to form a ball screw mechanism and supported for axial movement on the brackets 9 in parallel to the shaft 6, a driven gear 11 fixedly mounted on the threaded nut 12 and engaged with the drive gear 10, and a link 18 supported for turning by a pin 17 on a bracket 16 formed integrally with the housing 2, and having opposite ends connected to the respective middle parts of the screw shaft 13 and the shaft 6 by pivotal joints 14 and 15, respectively. The housing 2 is provided at the opposite ends of its front surface with gas inlets 19 opening into the nozzle 1 and 1', respectively, and with a bracket 20 formed integrally with the housing 2 on the back surface of the latter. A position sensor 21 is linked to the screw shaft 13 to measure the respective positions of the nozzle plugs 4 and 4' of the nozzles 1 and 1'. The servomotor 8 may be turned through an angle of 90° from a position shown in FIG. 1 to a position shown in FIG. 3, and the interlocking mechanism 7 for interlocking the servomotor 8 to the shaft 6 may comprise a drive gear 10 fixedly mounted on the output shaft of the servomotor 8, and a sector gear 18' formed in an upper part of the link 18 and engaged with the drive gear 10 as shown in FIGS. 3 and 4. In an arrangement shown in FIGS. 3 and 4, the position sensor 21 is interlocked with the sector gear 18'.

Figure 5:
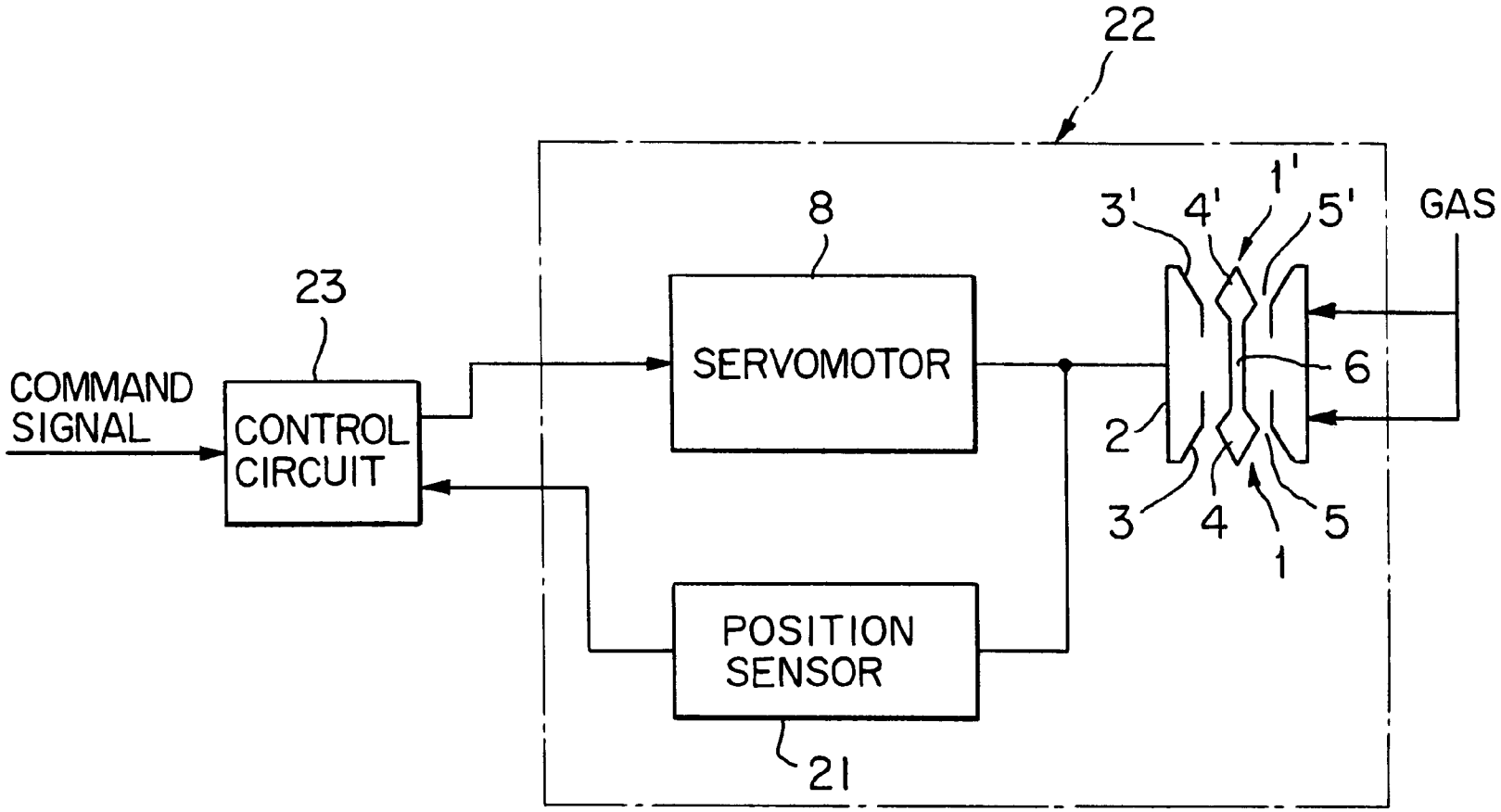
FIG. 5 is a block diagram of assistance in explaining an operation for controlling the variable thrust nozzle system of FIG. 1.

Referring to FIG. 5, a control circuit 23 is connected to the variable thrust nozzle system 22 and operates according to command signals. The control circuit 23 drives the servomotor 8 to move the nozzle plugs 4 and 4'. The respective positions of the nozzle plugs 4 and 4' are measured by the position sensor 21 through the measurement of the axial movement of the screw shaft 13. The position sensor 21 gives signals indicating the positions of the nozzle plugs 4 and 4' to the control circuit 23.

Figure 6:
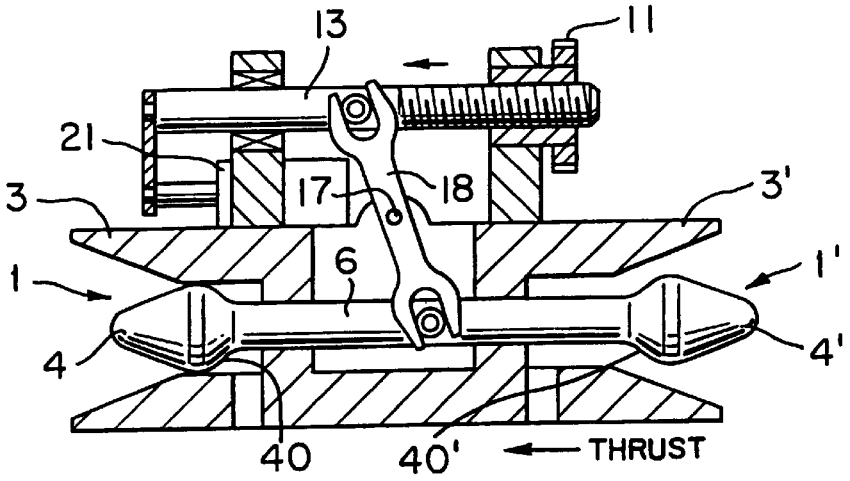
FIG. 6 is a longitudinal sectional view of the variable thrust nozzle system of FIG. 2 in a state where a right nozzle is opened and a left nozzle is closed.

The operation of the variable thrust nozzle system 22 will be described hereinafter. When a command signal requesting the production of a thrust by the right nozzle 1' is given to the control circuit 23, the servomotor 8 drives the screw shaft 13 for axial movement to the left, as viewed in FIG. 6 through the drive gear 10 and the driven gear 11 engaged with the dnve gear 10. Consequently, the link 18 is turned counterclockwise on the pin 17, and the shaft 6 having the nozzle plugs 4 and 4' is moved axially to the right, so that the left nozzle plug 4 is brought into contact with the inner circumference of the nozzle skirt 3 to close the left nozzle 1, and the right nozzle plug 4' is separated from the inner circumference of the nozzle skirt 3' to open the right nozzle 1'. Thus, a gas is jetted through the right nozzle 1' to produce a thrust toward the left as indicated by the arrow in FIG. 6. The position sensor 21 measures the respective positions of the nozzle plugs 4 and 4' and gives signals indicating the measured positions of the nozzle plugs 4 and 4' to the control circuit 23. The control circuit 23 stops the servomotor 8 upon the reception of the signals indicating desired positions of the nozzle plugs 4 and 4' from the position sensor 21.

Figure 7:
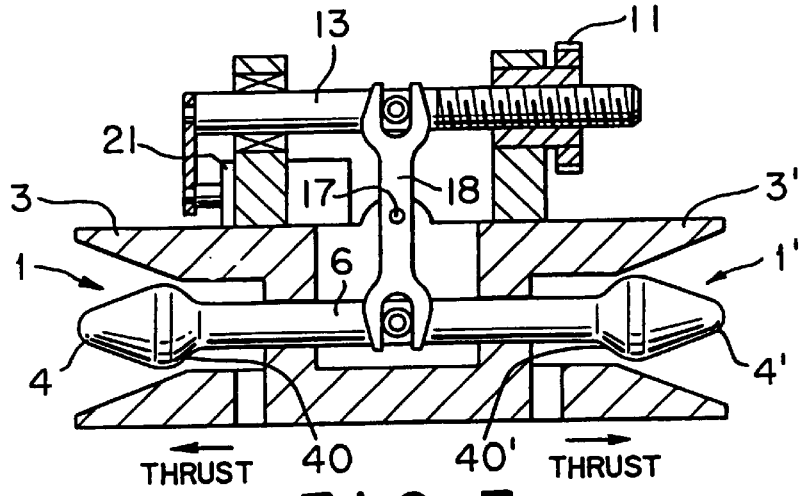
FIG. 7 is a longitudinal sectional view of the variable thrust nozzle system of FIG. 2 in a neutral state where the right and the left nozzles are half opened.

When a command signal requesting the production of thrusts respectively acting in opposite directions as indicated by the arrows in FIG. 7 by both the nozzles 1 and 1' is given subsequently to the control circuit 23, the servomotor 8 is reversed to rotate the driven gear 11 engaged with the drive gear 10 mounted on the output shaft of the servomotor 8 in the reverse direction. Then, the screw shaft 13 is moved axially by a fixed distance to the right, the link 18 is turned clockwise on the pin 17, and the shaft 6 provided with the nozzle plugs 4 and 4' is shifted by a fixed distance to the left. When the link 18 is turned to a vertical position as shown in FIG. 7, the nozzle plugs 4 and 4' are moved to their neutral positions where the nozzle plugs 4 and 4' are separated from the respective inner circumferences of the nozzle skirts 3 and 3', respectively. Consequently, the nozzles 1 and 1' are half opened evenly to set the variable thrust nozzle system in a neutral position where the gas is jetted evenly through the nozzles 1 and 1' to produce a thrust toward the right and left as indicated by the arrows in FIG. 7. Upon the detection of the arrival of the nozzle plugs 4 and 4' at their neutral positions, the position sensor 21 gives a signal to that effect to the control circuit 23, and then the control circuit 23 stops the servomotor 8.

Figure 8:
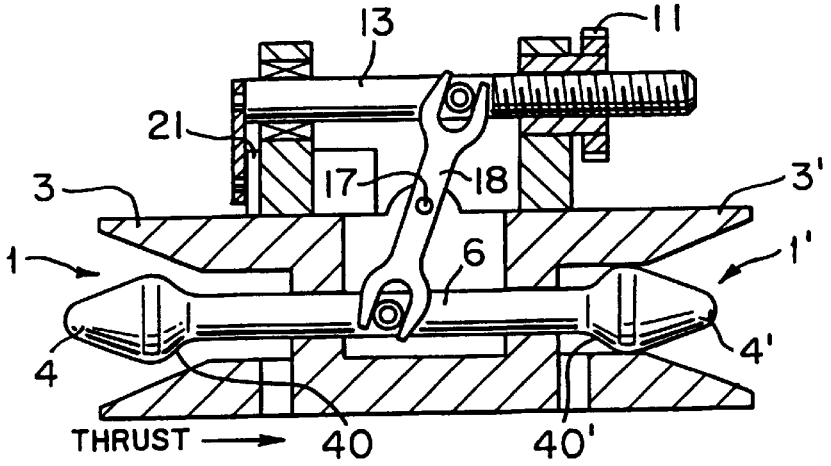
FIG. 8 is a longitudinal sectional view of the variable thrust nozzle system of FIG. 2 in a state where the right nozzle is closed and the left nozzle is opened.

When a command signal requesting the production of a thrust by the left nozzle 1 is given to the control circuit 23, the servomotor 8 drives the screw shaft 13 for axial movement to the right, as viewed in FIG. 8 through the drive gear 10 and the driven gear 11 engaged with the drive gear 10. Consequently, the link 18 is turned clockwise on the pin 17, and the shaft 6 having the nozzle plugs 4 and 4' is moved axially to the left, so that the right nozzle plug 4' is brought into contact with the inner circumference of the nozzle skirt 3' to close the right nozzle 1', and the left nozzle plug 4 is separated from the inner circumference of the nozzle skirt 3 to open the left nozzle 1. Thus, a gas is jetted through the left nozzle 1 to produce a thrust toward the right as indicated by the arrow in FIG. 8. The position sensor 21 measures the respective positions of the nozzle plugs 4 and 4' and gives signals indicating the measured positions of the nozzle plugs 4 and 4' to the control circuit 23. The control circuit 23 stops the servomotor 8 upon the reception of the signals indicating desired positions of the nozzle plugs 4 and 4' from the position sensor 21.

Figure 9:
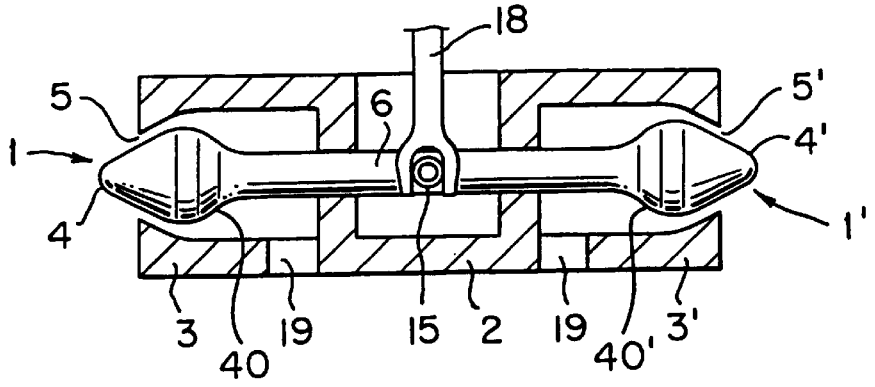
FIG. 9 is a sectional view of a nozzle of a shape resembling that of a plug nozzle.

This variable thrust nozzle system differentially varies the thrusts produced by the nozzles 1 and 1' having the nozzle skirts 3 and 3' each defining an outwardly expanding tapered nozzle hole. The servomotor 8 may be driven continuously to vary continuously the rusts produced by the nozzles 1 and 1'. Naturally, the variable thrust nozzle system 22 may employ nozzles 1 and 1' having skirts 3 and 3' each defining an inwardly expanding tapered nozzle hole as shown in FIG. 9.

Since the two nozzles 1 and 1' of the variable thrust nozzle system 22 shown in FIGS. 1 and 2 can alternately be opened and closed by the single servomotor 8, the variable thrust nozzle system 22 operates smoothly and has s simple construction. Since the sectional areas of the nozzle throats 5 and 5' of the two nozzles 1 and 1' can continuously and differentially by the single servomotor 8, the jets of the gas jetted through the two nozzles 1 and 1' can continuously and differentially be varied to vary the respective thrusts of the nozzles 1 and 1' continuously and differentially.

Figure 10:
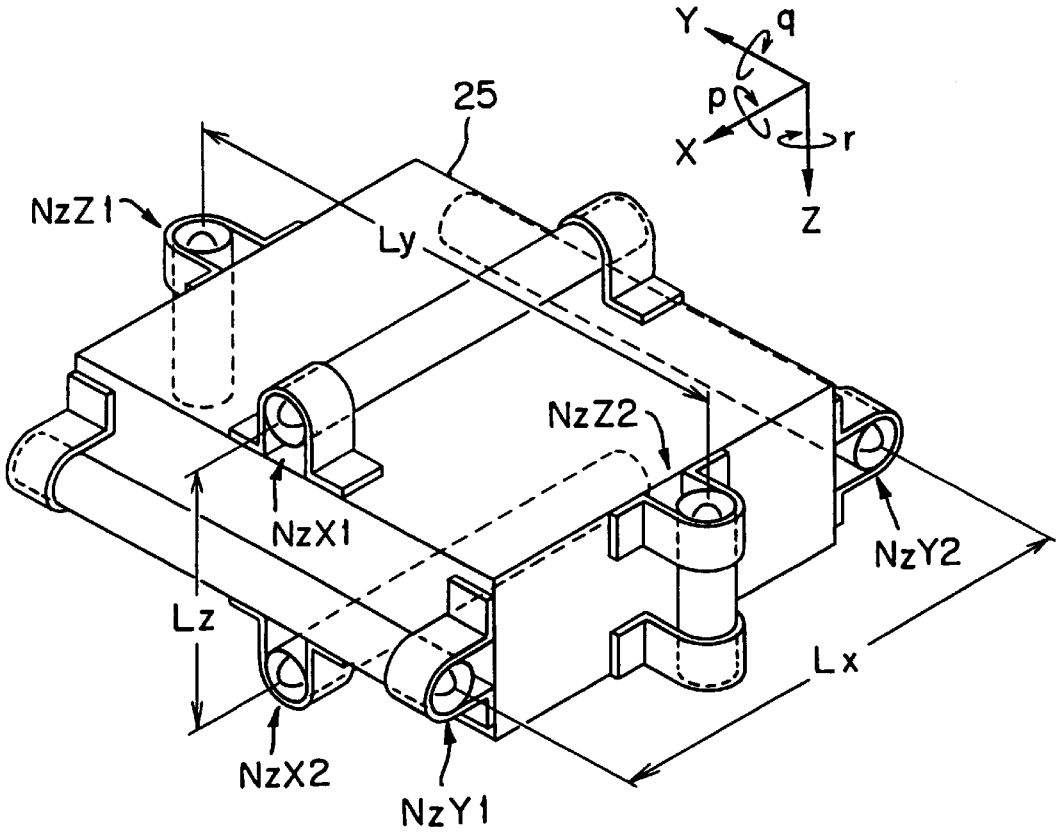
FIG. 10 is a perspective view of a platform provided in a symmetrical arrangement with six variable thrust nozzle systems in accordance with the present invention on its six sides, respectively.

If six variable thrust nozzle systems equivalent to the variable thrust nozzle systems 22 are disposed on the six sides of a platform 25 as shown in FIG. 10, the platform 25 can be controlled for motions in six degrees of freedom of motion, i.e., motions with respect to six axes including turning motions in directions p, q and r about three axes X, Y and Z and translating motions along the axes X, Y and Z.

Figure 11:
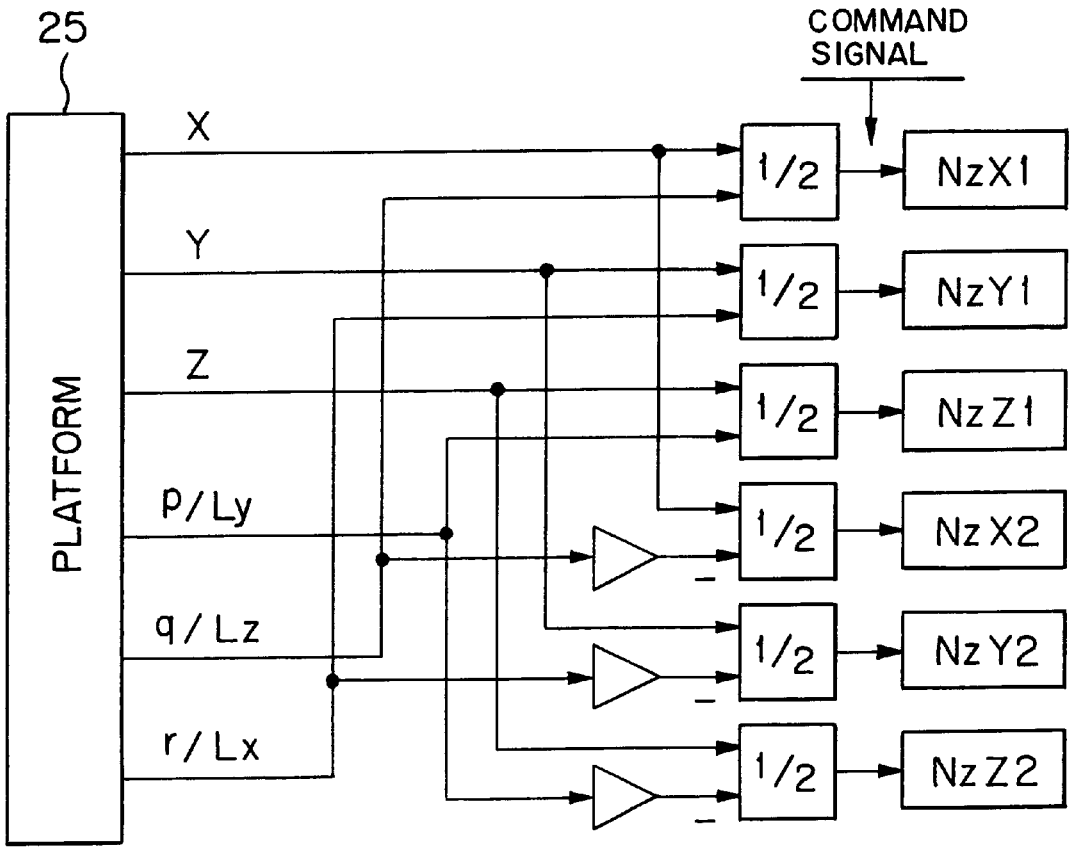
FIG. 11 is a block diagram of a control system for controlling the six variable thrust nozzle systems incorporated into the platform of FIG. 10.
Figure 12:
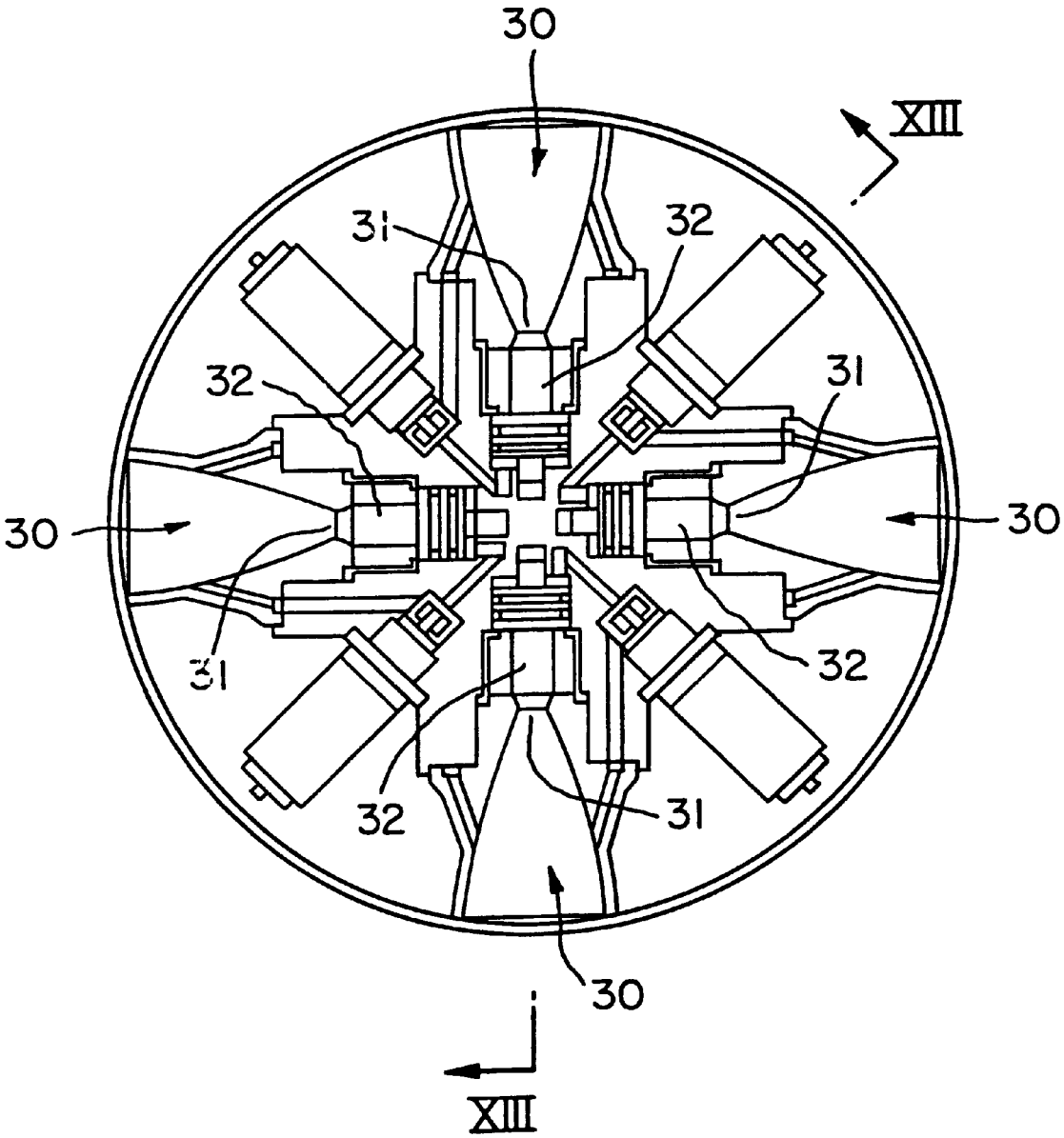
FIG. 12 RELATED ART
FIG. 12 is a front view of a conventional attitude controller.
Figure 13:
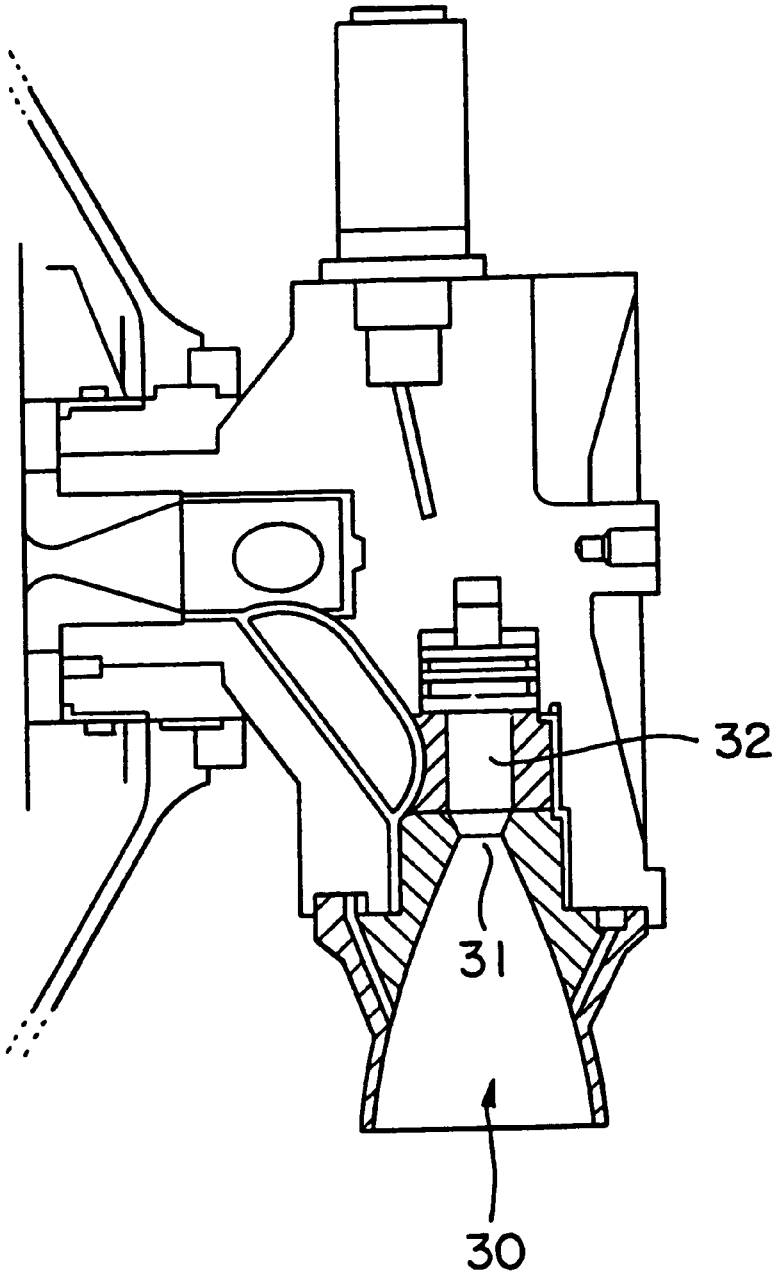
FIG. 13 RELATED ART
FIG. 13 is a sectional view taken on line XIII—XIII in FIG. 12.

As shown in FIG. 10, X-axs variable thrust nozzle systems NzXl and NzX2 for producing thrusts in directions parallel to the X-axis are disposed at a center distance Lz, Y-axis variable thrust nozzle systems NzY1 and NzY2 for producing thrusts in directions parallel to the Y-axis are disposed at a center distance Lx, and Z-axis variable thrust nozzle systems NzZ1 and NzZ2 for producing thrusts in directions parallel to the Z-axis are disposed at a center distance Ly. A force Fx=[NzX1+NzX2]/2 acts along the X-axis, a force Fy=[NzY1+NzY2]/2 acts along the Y-axis, and a force Fz=[NzZ1+NzZ2]/2 acts along the Z-axis. A torque Tp={[NzZ1+NzZ2]/2}×Ly about the X-axis is produced, a torque Tq={[NzX1+NzX2]/2}×Lz about the Y-axis is produced, and a torque Tr={[NzY1+NzY2]/2}×Lx about the Z-axis is produced. It should be noted that variables NzX1, NzX2, NzY1, NzY2, NzZ1 and NzZ2 in the above equations represent forces of the respective nozzles. FIG. 11 is a block diagram of a controller for controlling the platform 25 for motions about the six axes. The variable thrust nozzle systems NzX1, NzX2, NzY1, NzY2, NzZ1 and NzZ2 are controlled by control signals given to their control circuits.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A variable thrust nozzle system, comprising:

a housing;

a pair of nozzle skirts attached to an outer surface of said housing so as to open in opposite directions, respectively;

a pair of nozzle plugs disposed in said pair of nozzle skirts so as to define a nozzle throat between an outer surface of each of said nozzle plugs and an inner surface of each of the corresponding nozzle skirts, each of said nozzle plugs having an inwardly converging portion to receive a gas pressure in said housing;

a shaft supported for sliding in said housing and having opposite ends connected to said nozzle plugs, respectively; and an actuator linked to said shaft to drive said shaft for sliding motions to vary sectional areas of said nozzle throats.

2. The variable thrust nozzle system according to claim 1, wherein said actuator is a servomotor.

3. The variable thrust nozzle system according to claim 1, further comprising an interlocking mechanism for inking said actuator to said shaft, said interlocking mechanism having a link pivotally supported at its middle part on said housing so as to be driven by the actuator and connected at one end of said link to a middle part of said shaft by a rotary joint.

4. The variable thrust nozzle system according to claim 3, wherein the other end of said link is connected to a screw shaft driven by the actuator.

5. The variable thrust nozzle system according to claim 3, wherein a sector gear is formed on the other end of said link, and said sector gear is engaged with a drive gear driven by the actuator.

6. The variable thrust nozzle system according to claim 4, further comprising a position sensor for measuring respective positions of said nozzle plugs in the corresponding nozzle skirts through a measurement of the movement of said screw shaft, wherein said actuator is controlled on the basis of the positions of said nozzle plugs measured by said position sensor.

7. The variable thrust nozzle system according to claim 5, further comprising a position sensor for measuring respective positions of said nozzle plugs in the corresponding nozzle skirts through a measurement of the angular movement of said sector gear, wherein said actuator is controlled on the basis of the positions of said nozzle plugs measured by said position sensor.

8. The variable thrust nozzle system according to claim 1, wherein each of said nozzle skirts defines an outwardly expanding tapered nozzle hole, and each of said nozzle plugs has an external shape capable of varying sectional area of each of said nozzle throats when each of said nozzle plugs is moved in each of the corresponding nozzle skirts.

9. The variable thrust nozzle system according to claim 1, wherein each of said nozzle skirts defines an inwardly expanding tapered nozzle hole, and each of said nozzle plugs has an external shape capable of varying sectional area of each of said nozzle throats when each of said nozzle plugs is moved in each of the corresponding nozzle skirts.

* * * * *